US006065355A

United States Patent [19]

Schultz

[11] Patent Number: 6,065,355

[45] Date of Patent: May 23, 2000

[54] NON-FLASHING DOWNHOLE FLUID SAMPLER AND METHOD

[75] Inventor: Roger L. Schultz, Stillwater, Okla.

[73] Assignee: Halliburton Energy Services, Inc., Dallas, Tex.

[21] Appl. No.: 08/935,867

[22] Filed: Sep. 23, 1997

[51] Int. Cl.[7] ..... G01N 1/20; E21B 49/08

[52] U.S. Cl. ..... 73/864; 73/863.01; 73/864.51; 73/864.62; 73/864.63; 166/264

[58] Field of Search ..... 73/864, 864.63, 73/863.02, 863.03, 863.01, 864.51, 864.62, 152.23, 152.27, 152.28; 166/162, 264

[56] References Cited

U.S. PATENT DOCUMENTS

| | | | |
|---|---|---|---|
| 3,877,309 | 4/1975 | Hance | 73/864.57 |
| 3,912,455 | 10/1975 | Lichtenstein | 422/61 |
| 4,056,967 | 11/1977 | Roberts | 73/864.81 |
| 4,137,773 | 2/1979 | Loncaric | 73/863.86 |
| 4,409,825 | 10/1983 | Martin et al. | 73/152.27 |
| 4,463,599 | 8/1984 | Welker | 73/864.62 |
| 4,787,447 | 11/1988 | Christensen | 166/169 |
| 4,903,765 | 2/1990 | Zunkel | 166/162 |
| 5,058,674 | 10/1991 | Schultz et al. | 166/264 |
| 5,240,072 | 8/1993 | Schultz et al. | 166/169 |
| 5,687,791 | 11/1997 | Beck et al. | 166/264 X |

*Primary Examiner*—Thomas P. Noland
*Attorney, Agent, or Firm*—William M. Imwalle; Neal R. Kennedy

[57] ABSTRACT

A non-flashing fluid sampler for use in obtaining a well fluid sample. The sampler comprises a body defining a first chamber, a second chamber, a third chamber and a sampling port therein. The sampling port is in communication with the first chamber and with an outside zone outside the body. The second and third chambers are initially isolated from one another by a control valve. Upon activating the control valve, fluid may flow from the second chamber to the third chamber through a flow restriction. An extendable floating piston is disposed between the first and second chambers, and the floating piston defines a variable volume therein. An initial amount of well fluid flows into the variable volume, thus trapping dirty fluid, and subsequently, a well fluid sample is flowed into the first chamber. An isolation valve is provided for allowing hydrostatic pressure into the sampler after the fluid sample has been taken. Check valves prevent outward fluid flow from the sampler and thereby trap the hydrostatic pressure therein. Methods of use of the sampling apparatus are also disclosed.

17 Claims, 4 Drawing Sheets

NON-FLASHING DOWNHOLE FLUID SAMPLER AND METHOD

BACKGROUND OF THE INVENTION

1. Field Of The Invention

This invention relates generally to a fluid sampling tool and method of use which, in response to pressure, opens to collect a fluid sample, and more particularly, to a sampling tool which provides for collection of a fluid sample without flashing of vapor in the liquid and which retains the fluid in a supercharged condition.

2. Description Of The Prior Art

In general, to obtain a sample of fluid in an oil or gas well, a fluid sampling tool is first lowered into the well on a tubing string or a wireline or a slick line. When the tool is at the desired depth, a port (one or more openings) defined in the tool is opened. The port may open in response to pressure exerted through the well fluid or in response to an electrical actuation signal from the surface. The open port admits well fluid into a sample retaining chamber within the tool. The port is thereafter closed, the tool is withdrawn from a well, and the sample is taken from the chamber for analysis.

U.S. Pat. No. 4,903,765 to Zunkel, assigned to the assignee of the present invention, shows an improvement in such fluid sampling tools, wherein the fluid sampling tool is constructed to have a time delay which starts when a valve of a tool first starts to move in response to pressure from the well. This time delay provides various advantages. In one instance, the time delay allows undesired fluid such as drilling fluids to bypass the sampling tool before the valve communicates a sample port with a sample chamber and a sample of the well fluid is taken. In another instance, the time delay can reduce the dependency on accurate pressure readings and shear pins which control the opening of the valve. For example, when a maximum bottom hole pressure is measured or otherwise anticipated, shear pins providing a holding force of something less than this maximum pressure, but one which will clearly be encountered somewhere downhole despite a lack of assurance as to precisely where it will be, can be used so that the pins will break at some location above the bottom of the well. This time delay, designed with a suitable tolerance to assure reaching bottom before its expiration, is then used to allow the tool to be run on down to the well bottom, where it is ultimately automatically opened.

U.S. Pat. No. 5,058,674 to Schultz et al., also assigned to the assignee of the present invention, provides various improvements upon a delayed opening fluid sampler of the type generally shown in the Zunkel patent. These improvements relate generally to various means for controlling the actuation of the valve which controls flow of the sample fluid to the sample chamber.

A problem with some prior art fluid samplers is that the sample is obtained relatively quickly which can cause the fluid to flash (separation of the liquid and vapor stages) as it is flowing into the sampling chamber. This is an undesirable condition and can affect the quality of the fluid sample. The sampler of the present invention provides for controlled flowing of the fluid into the sample chamber which greatly reduces or eliminates fluid flashing.

Another problem with some prior fluid samplers is that when they are removed from the wellbore, the reduction in hydrostatic pressure acting on the sampler as it is raised also results in fluid pressure therein being reduced. The drop in pressure can cause phase change degradation of the sample.

That is, flashing can occur as the sampler is removed from the wellbore. The sampler of the present invention solves this problem by providing for the fluid sample to be trapped at well hydrostatic pressure regardless of the pressure outside the sampler. This "supercharging" of the fluid sample greatly reduces or eliminates phase change problems.

SUMMARY OF THE INVENTION

The present invention includes a non-flashing fluid sampler used in obtaining a well fluid sample and also includes methods of sampling a well using the fluid sampler.

The fluid sampling apparatus comprises a body having a first chamber, a second chamber, a third chamber and a sampling port defined therein. The sampling port is in communication with the first chamber and with an outside zone outside the body. The apparatus may further comprise a flow restrictor, disposed in the body between the second and third chambers, for impeding fluid flow from the second chamber to the third chamber.

The apparatus may also comprise a control valve, disposed in the body between the second and third chambers, for initially isolating the second chamber from the third chamber and for placing the second chamber in communication with the third chamber when activated so that, as fluid flows from the second chamber to the third chamber, fluid from the outside zone may flow through the sampling port into the first chamber.

An activator is provided for activating the control valve. In a preferred embodiment, the body further defines a control port therein which is communicated with the control valve and a second outside zone outside the body. The activator is disposed in the control port and adapted for opening the control port and activating the control valve in response to pressure from the second outside zone. The activator may be characterized as adapted for activating the control valve when a pressure differential between the second outside zone and the control valve reaches a predetermined level. This activator may be characterized by a rupture disc disposed across the control port.

The sampling apparatus may further comprise a floating piston disposed between the first chamber and the second chamber and movable in response to fluid flow from the second chamber to the third chamber which results in fluid flow from the outside zone in communication with the sampling port into the first chamber. The floating piston preferably comprises a first piston portion and a second piston portion adjacent to the first piston portion. The first and second piston portions are relatively movable and define a variable volume therebetween. A lock is provided for locking the first and second piston portions together after predetermined relative movement therebetween. The variable volume is in communication with the sampling port and allows a portion of fluid flowing through the sampling port to flow into the variable volume before the first chamber is filled. In this way, "dirty" fluid is flowed before overall movement of the floating piston to enlarge the first chamber.

A check valve is provided in communication with the sampling port for allowing fluid flow from the sampling port into the first chamber in response to movement of the floating piston while preventing fluid flow from the first chamber outwardly through the sampling port.

The fluid sampling apparatus further comprises an isolation valve, disposed in the body, for allowing hydrostatic pressure from the well into the body, thereby communicating the hydrostatic pressure to the first, second and third chambers. Another check valve is provided for preventing fluid flow outwardly from the body and for trapping the hydrostatic pressure in the body.

A second floating piston is disposed in the body and is in communication with the third chamber and movable in response to fluid flow from the second chamber to the third chamber. The apparatus further comprises a plunger for engaging the isolation valve in response to predetermined movement of the second floating piston. In one embodiment, the plunger is adjacent to the isolation valve and movable by the second floating piston in response to the predetermined movement of the second floating piston such that the isolation valve is opened. The body further defines a fourth chamber therein, and the plunger is disposed in the fourth chamber. The fourth chamber is preferably air filled.

The plunger preferably defines a differential area thereon such that, when the hydrostatic pressure is applied to the plunger, the plunger and second floating piston are forced downwardly which raises the pressure in the first, second and third chambers of the body to a level above well hydrostatic pressure.

The present invention also includes a method of sampling a well which comprises the step of running a fluid sampling tool into the well to a depth at which the well is to be sampled, the fluid sampling tool comprising: a body having a first chamber, a second chamber, a third chamber and a sampling port defined therein, the sampling port being communicated with the well outside the body; and a control valve disposed in the body and isolating the second chamber from the third chamber. This method further comprises the steps of activating the control valve and thereby placing the second chamber in communication with the third chamber so the fluid may flow from the second chamber to the third chamber, and flowing fluid from the well into the first chamber through the sampling port. The step of activating the control valve may comprise applying well pressure to a portion of the control valve, and in a particular embodiment, may comprise rupturing a rupture disc between the control valve and the well outside the body.

The fluid sampling tool may further comprise a fluid flow restriction in the body between the second and third chambers. The second chamber is placed in communication with the third chamber through the fluid flow restriction so that the fluid may flow slowly from the second chamber to the third chamber.

Stated in another way, the present invention includes a method of sampling a well which comprises the step of running a fluid sampling tool into the well to a depth at which the well is to be sampled wherein the fluid sampling tool comprises: a body defining a first chamber, a second chamber, a third chamber and a sampling port therein, said sampling port being communicated with the well outside the body; and a floating piston disposed in the body between the first and second chambers. This method further comprises the steps of flowing fluid from the second chamber to the third chamber, flowing an initial quantity of well fluid through the sampling port into a variable volume defined in the floating piston, and, after flowing the initial quantity of well fluid, flowing an additional amount of fluid into the first chamber.

Stated in still another way, the present invention includes a method of sampling a well which comprises the step of running a fluid sampling tool into the well at a depth at which the well is to be sampled, wherein the sampling tool comprises: a body defining a first chamber, a second chamber, a third chamber and a sampling port therein, the sampling port being communicated with the well outside the body; and an isolation valve disposed in the body. This method further comprises the steps of flowing fluid from the second chamber to the third chamber, flowing a fluid sample through the sampling port into the first chamber, and activating the isolation valve for allowing hydrostatic pressure from the well into the body and thereby communicating the hydrostatic pressure to the first, second and third chambers. This method may comprise the additional step of preventing fluid flow outwardly from the body and trapping the hydrostatic pressure in the body. This method may also comprise the additional step of raising the fluid pressure in the first, second and third chambers of the body to a level above well hydrostatic pressure.

Numerous objects and advantages of the invention will become apparent to those skilled in the art as the following description of the preferred embodiment is read in conjunction with the accompanying drawings.

DETAILED DESCRIPTION OF THE PREFERRED EMBODIMENT

Figure 1:
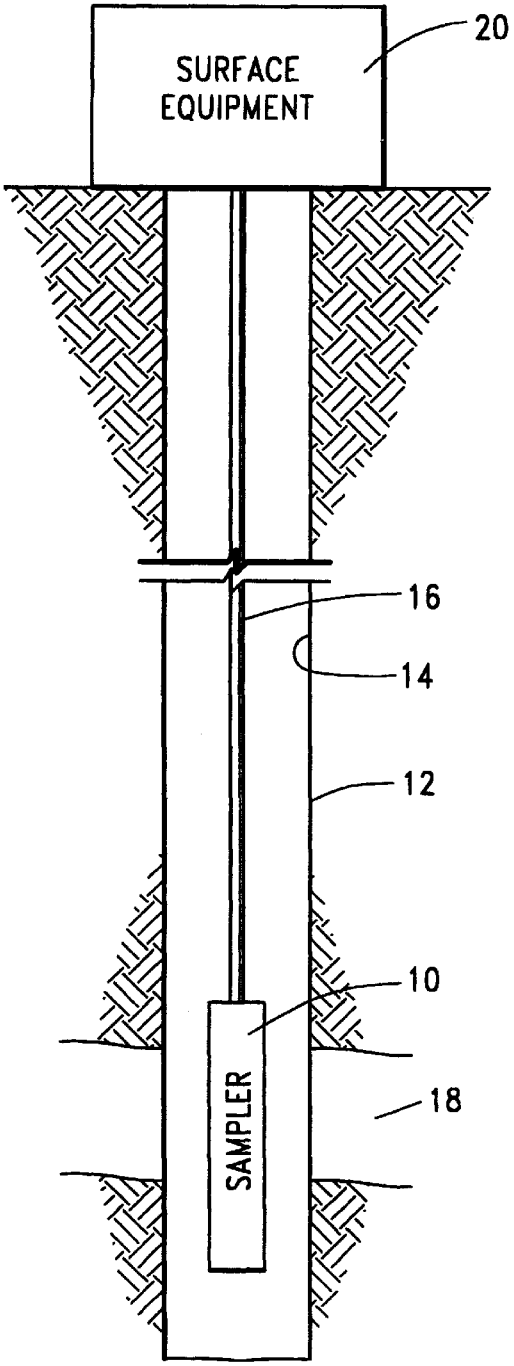
FIG. 1 is a schematic block diagram depicting the non-flashing fluid sampler of the present invention in place within a well which is to be sampled.

Referring now to the drawings, and more particularly to FIG. 1, the non-flashing downhole fluid sampler of the present invention is shown and generally designated by the numeral 10. Sampler 10 is shown disposed in an oil or gas well 12 having a wellbore 14. Wellbore 14 may or may not be lined with casing. Sampler 10 is lowered and raised relative to wellbore 14 by any one of various known means, such as a tubing string 16. It will be understood by those skilled in the art that sampler 10 can also be run on a slick line, on a wireline, and/or above or below a packer as is well known. Wellbore 14 is shown intersecting a subsurface formation or zone of interest 18, the flow from which is to be sampled. Fluids from formation or zone 18 flow into well 12 and are sampled by sampler 10.

Sampler 10 is lowered from and controlled by various surface equipment schematically illustrated at 20, which is located at the surface of the well.

Figure 2:
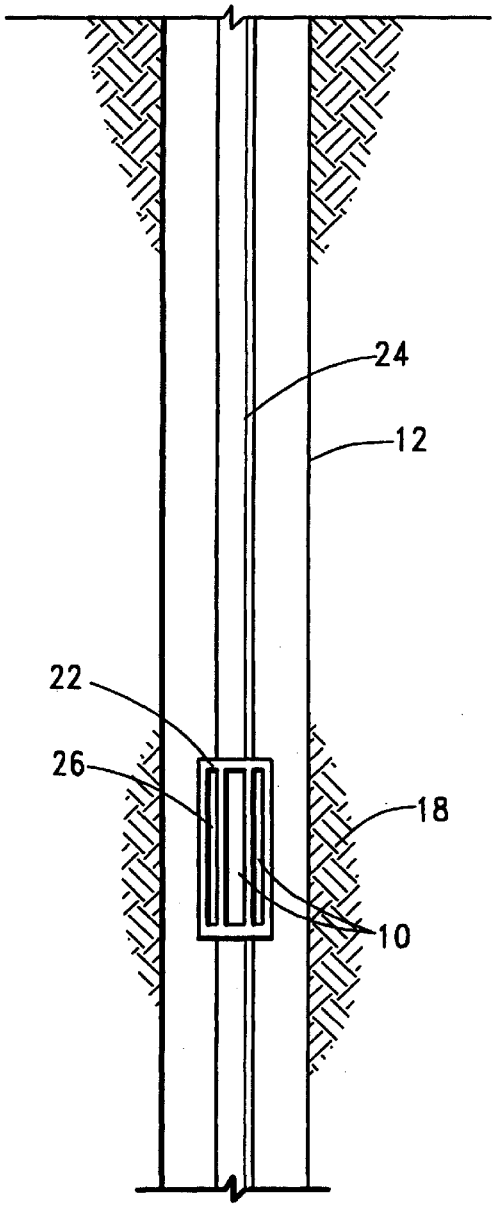
FIG. 2 schematically shows a plurality of samplers of the present invention mounted in a sampling apparatus or carrier positioned within a well.

Another particular environment in which sampler 10 can be used is in a large sampling apparatus or carrier 22 which may hold a plurality of samplers 10, as illustrated in FIG. 2. Sampling apparatus or carrier 22 may be part of a downhole tool 24 such as, but not limited to, an early evaluation testing string usable in an uncased wellbore. Measuring instruments 26, such as pressure and temperature gauges, may also be mounted in sampling apparatus or carrier 22 along with samplers 10.

Figures 3A, 4A, 5A:
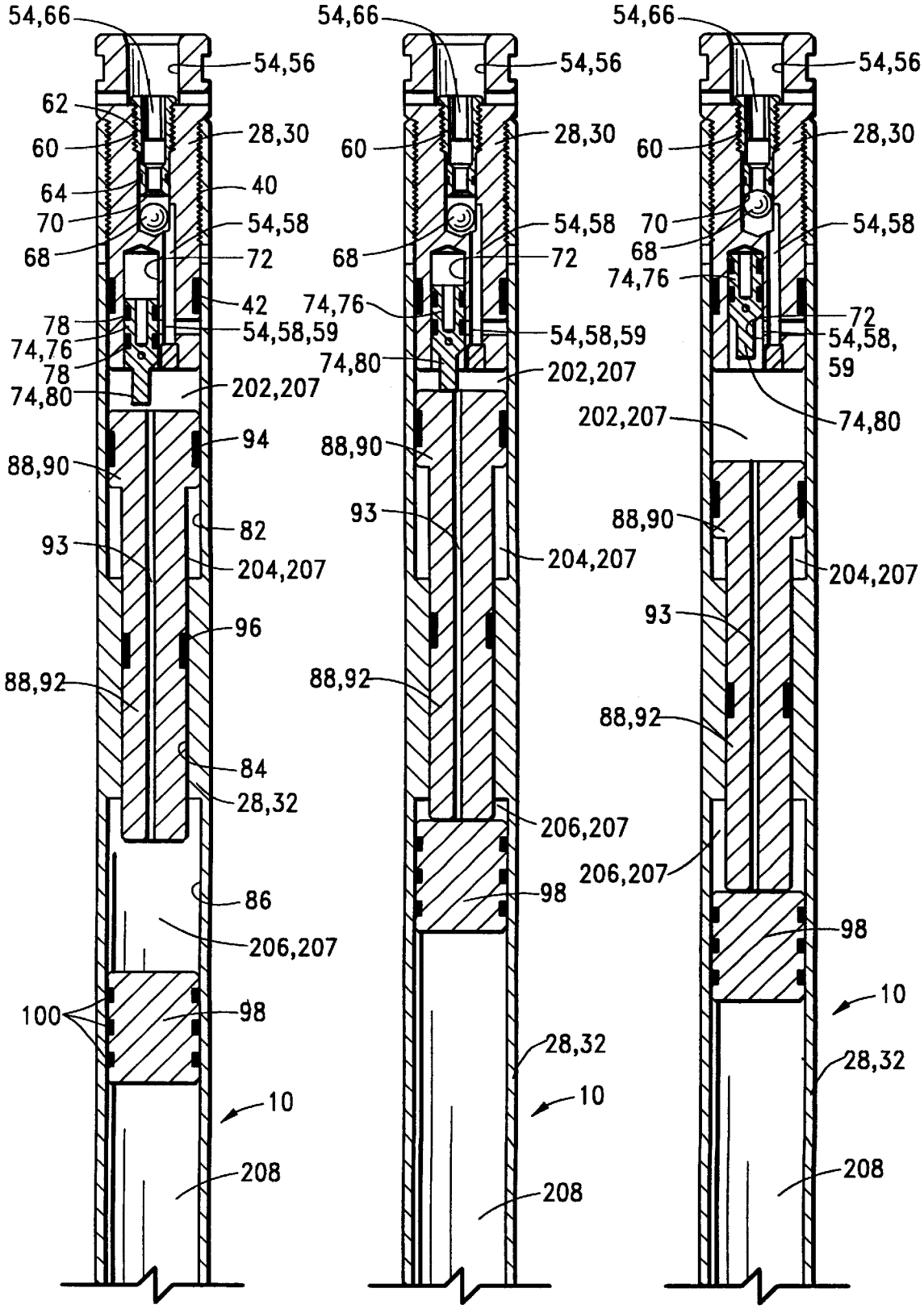
FIGS. 3A–3C show the fluid sampler of the present invention as it is run into a wellbore.
FIGS. 4A–4C show the sampler as a fluid sample is being taken.
FIGS. 5A–5C show the sampler with a fluid sample captured therein.
Figure 3B:
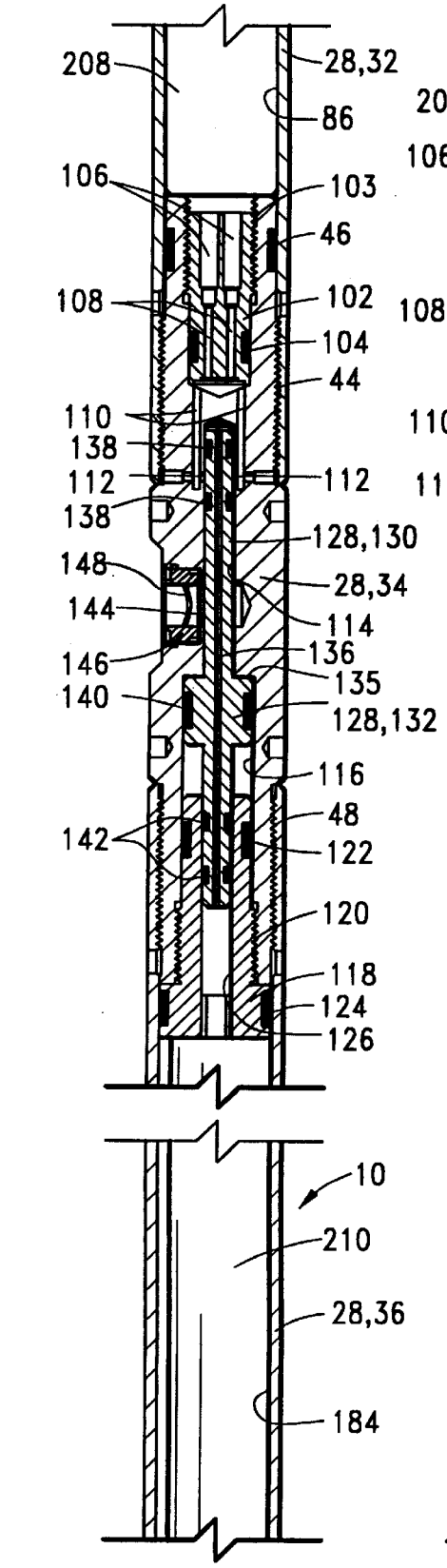
Figure 3C:
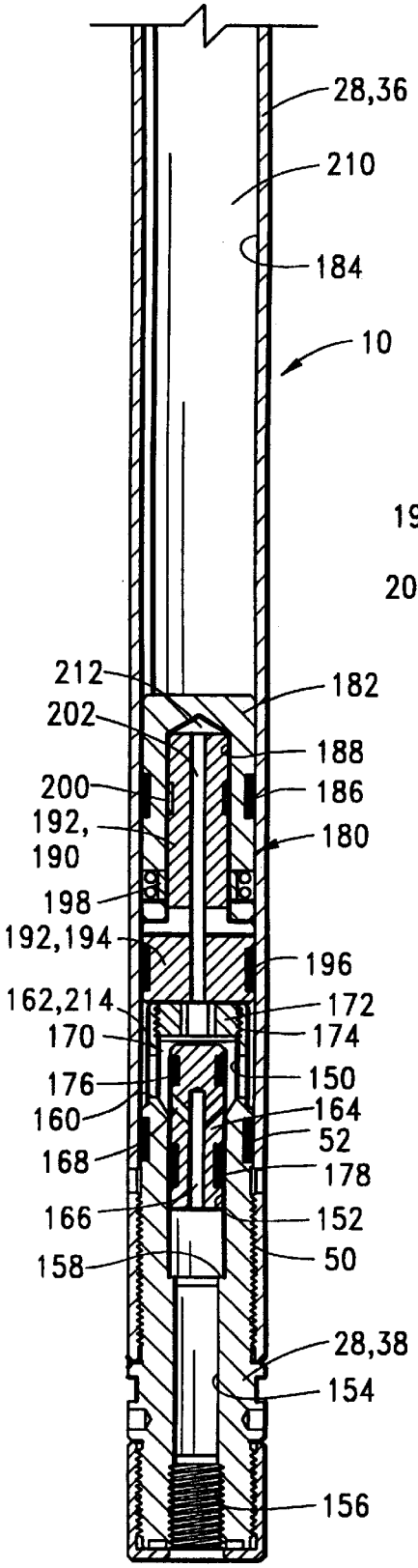

Referring now to FIGS. 3A–3C, the details of sampler 10 will be discussed. Sampler 10 comprises a body or housing 28. Housing 28 includes an upper adapter 30, an upper cylinder 32, an intermediate adapter 34, a lower cylinder 36 and a lower adapter 38.

Upper adapter 30 is attached to upper cylinder 32 at threaded connection 40, and a seal 42 provides sealing engagement between upper adapter 30 and upper cylinder 32. The lower end of upper cylinder 30 is attached to intermediate adapter 34 at threaded connection 44, and a seal 46 provides sealing engagement therebetween. Intermediate adapter 34 is attached to the upper end of lower cylinder 36 at threaded connection 48. The lower end of lower cylinder 36 is attached to lower adapter 38 at threaded connection 50, and a seal 52 provides sealing engagement therebetween.

Upper adapter 30 defines a flow passageway 54 therethrough including a port 56 and a passage 58. Passage 58 includes a transverse portion 59. A check valve adapter 60 is disposed in passage 54 and connected to upper adapter 30 by a threaded connection 62. A seal 64 provides sealing engagement between check valve adapter 62 and upper adapter 30. A central opening 66 through check valve adapter 60 provides communication between port 56 and passage 58 and thus may be said to form part of passageway 54. A check valve, such as a ball check valve 68, is disposed in upper adapter 30 below check valve adapter 60. As seen in FIG. 3A, ball check valve 68 is in an open position. When in a closed position, as shown in FIG. 5A, ball check valve 68 is adapted for sealing engagement with a seat 70 on check valve adapter 60, as will be further discussed herein.

Upper adapter 30 defines an off-center longitudinal bore 72 therein which intersects transverse passage portion 59 and thus is in communication with passageway 54. An isolation valve, such as a sliding isolation valve 74, is disposed in bore 72. An enlarged upper portion 76 of isolation valve 74 carries a pair of seals 78 thereon. Seals 78 seal on opposite sides of horizontal portion 59 of passage 58 when isolation valve 74 is in the initial position shown in FIG. 3A. A smaller diameter lower portion 80 of isolation valve 74 extends downwardly from upper portion 76 and below upper adapter 30.

Upper cylinder 32 defines a first bore 82, a smaller second bore 84, and a third bore 86 therein which is larger than second bore 84. A plunger 88 is disposed in upper cylinder 32 and has an enlarged upper end 90 slidably disposed within first bore 82 of the upper cylinder and a smaller lower end 92 slidably disposed in second bore 84. It will be seen that an annular area differential is defined between enlarged upper end 90 and smaller lower end 92 of plunger 88. Plunger 88 defines a longitudinally extending opening 93 therethrough. A seal 94 provides sealing engagement between upper end 90 of plunger 88 and first bore 82, and similarly, another seal 96 provides sealing engagement between lower end 92 and second bore 84.

A floating piston 98 is disposed in third bore 86 of upper cylinder 32 and is initially spaced below plunger 88. Sealing is provided between floating piston 98 and third bore 86, such as by a plurality of seals 100.

Referring now to FIG. 3B, an orifice or restriction port adapter 102 is disposed in intermediate adapter 34 and is engaged therewith at threaded connection 103. A seal 104 provides sealing engagement between orifice adapter 102 and intermediate adapter 34. A plurality of longitudinally extending ports 106 are defined in orifice adapter 102. A longitudinally extending flow restriction port 108 is in communication with each of ports 106. Flow restriction ports 108 are sized sufficiently small to restrict fluid flow therethrough. Flow restriction ports 108 may also be referred to as orifices 108. Other flow restriction devices, such as removable orifices may also be used. Thus, it may be said that sampler 10 includes a flow restrictor for impeding fluid flow between upper cylinder 32 and lower cylinder 36, as will be further described herein.

The lower end of orifice adapter 102 is in communication with a plurality of passageways 110, each of which having a transversely extending portion 112.

Intermediate adapter 34 defines a first bore 114 therein and a larger second bore 116. First bore 114 intersects, and is in communication with, transverse portions 112 of passageways 110.

A valve adapter 118 is attached to the lower end of intermediate adapter 34 at threaded connection 120. A seal 122 provides sealing engagement between valve adapter 118 and intermediate adapter 34. Another seal 124 provides sealing engagement between valve adapter 118 and lower cylinder 36. Valve adapter 118 defines a bore 126 therethrough which is smaller than second bore 116 in intermediate adapter 34 and is substantially coaxial with first bore 114 and second bore 116 in the intermediate adapter.

A control valve 128 is disposed in intermediate adapter 34 for initially isolating lower cylinder 36 from upper cylinder 32 and for placing the lower cylinder in communication with the upper cylinder when activated. In the preferred embodiment, the control valve is characterized by a slidable control valve 128 of the configuration shown in FIG. 3B. An upper portion 130 of control valve 128 extends into first bore 114 of intermediate adapter 34, an enlarged central portion 132 of the control valve is disposed in second bore 116 of the intermediate adapter, and a lower portion 134 extends into bore 126 of valve adapter 118. An upwardly facing shoulder 135 on control valve 128 extends between upper portion 130 and central portion 132. A central opening 136 is defined through control valve 128 and thus provides communication between first bore 114 in intermediate adapter 34 and bore 126 in valve adapter 118.

Seals 138 provide sealing engagement between upper portion 130 of control valve 128 and first bore 114 in intermediate adapter 34. Seals 138 are disposed on opposite sides of transverse portions 112 of passageways 110 when control valve 128 is in the closed position shown in FIG. 3B, thus closing passageways 110. A seal 140 provides sealing engagement between central portion 132 of control valve 128 and second bore 116 of intermediate adapter 34. Seals 142 provide sealing engagement between lower portion 134 of control valve 128 and valve adapter 118.

A transverse opening or control port 144 is defined in intermediate adapter 34, and this transverse opening intersects first bore 114. A control valve activator is in communication with control port 144. In the preferred embodiment, the control valve activator is characterized by a rupture disc adapter 146 with a rupture disc 148 therein. Rupture disc adapter 146 and rupture disc 148 are disposed in control port 144, and rupture disc 148 is designed to rupture when a predetermined differential pressure is placed thereacross. That is, when annulus pressure outside sampler 10 is raised to a sufficient level over the pressure in sampler 10, rupture disc 148 will rupture and open control port 144. In this embodiment, the control valve activator may be referred to as an annulus pressure responsive activator. However, other types of activators, such as an electronically controlled solenoid valve, or other means for opening a port known in the art may be used, and the invention is not intended to be limited to the specific configuration shown in the drawings. Basically, the activator is adapted for providing communication between control valve 128 and well fluid in an outside zone outside sampler 10 when desired.

Referring now to FIG. 3C, it will be seen that lower adapter 134 defines a first bore 150, a smaller second bore 152 below first bore 150, and a still smaller third bore 154 which opens downwardly. Third bore 154 may also be referred to as a sampling port 154 and has a threaded surface 156 at the lower end thereof. An upwardly facing shoulder 158 extends between second bore 152 and sampling port 154.

A plurality of transverse openings 160 provide communication between first bore 150 and an annular volume 162 defined between lower cylinder 36 and an upper end of lower adapter 38.

A check valve 164 is disposed in lower adapter 38 for allowing fluid flow through sampling port 154 into lower cylinder 36 while preventing fluid flow from the lower cylinder outwardly through the sampling port. In the preferred embodiment, check valve 164 is characterized by a slidable check valve 164 which is slidably disposed in second bore 152 of lower adapter 38. Check valve 164 defines a flow passageway 166 therein which includes angularly disposed portions 168.

When check valve 164 is in the open position shown in FIG. 3C, it will be seen that communication is provided through passageway 166, an annular volume 170 defined between check valve 164 and first bore 150 in lower adapter 38, ports 160 and annular volume 162. In other words, check valve 164, when opened, allows communication between an outside zone outside body 18 adjacent to the bottom of lower adapter 38 and the inside of lower cylinder 36 through sampling port 154. A check valve retainer 172 is attached to lower adapter 38 at threaded connection 174 and limits upward movement of check valve 164.

Figure 5C:
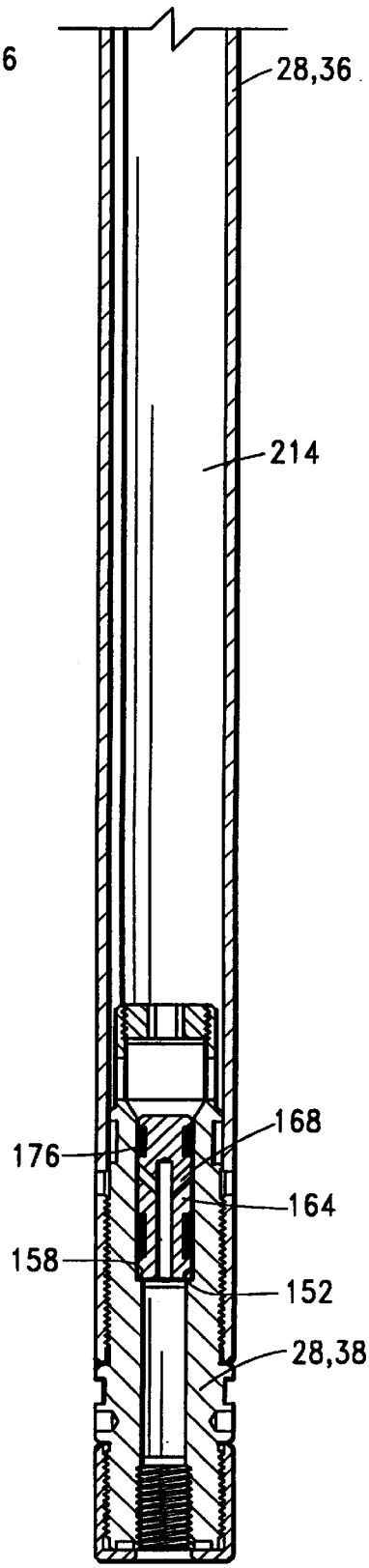

A pair of spaced seals 176 and 178 are disposed on opposite sides of angular portions 168 of passageway 166. When check valve 164 is in the closed position shown in FIG. 5C, it will be seen that seals 176 and 178 provide sealing engagement between check valve 164 and second bore 152 of lower adapter 38 to prevent communication between lower cylinder 36 and the lower end of the lower adapter, as will be discussed further herein.

Disposed above lower adapter 38 is an extendable floating piston 180. Piston 180 comprises a first or upper piston portion 182 slidably received in bore 184 defined in lower cylinder 36. A seal 186 provides sealing engagement between upper piston portion 182 in cylinder 36.

Upper piston portion 182 defines a bore therein. An upper end 190 of a second or lower piston portion 192 is slidably received in bore 188 such that there can be relative movement between upper piston portion 182 and lower piston portion 192. An enlarged lower end 194 of lower piston portion 192 is slidably received in bore 184 of lower cylinder 36.

A seal 196 provides sealing engagement between lower end 194 and lower cylinder 36.

A plurality of radially inwardly spring biased locking dogs 198 are disposed in upper piston portion 182 and bear against upper end 190 of lower piston portion 192. Locking dogs 198 are adapted for locking engagement with a radially outwardly facing groove 200 defined in upper end 190 of lower piston portion 192. Thus, a lock is provided for locking upper and lower piston portions 182 and 192 together after predetermined relative movement therebetween, as will be further described herein.

Lower piston portion 192 defines a central opening 202 therethrough which provides communication between the bottom of the lower piston portion and bore 188 in upper piston portion 182.

Operation Of The Invention

When sampler 10 is made up in the configuration shown in FIGS. 3A–3C, a number of chambers are defined therein. An air cavity 202 is defined between upper adapter 30 and plunger 88 and cavity 202 is initially filled with atmospheric air. Below upper end 90 of plunger 88 an annular air cavity 204 is defined and also initially filled with atmospheric air. Still another air cavity 206 is defined between plunger 88 and floating piston 98 in upper cylinder 32. Opening 93 through plunger 88 insures that pressure is equalized between air cavity 202 and air cavity 206. Air cavities 202, 204 and 206 may be jointly described as an air chamber 207 in which plunger 88 is slidably disposed.

An upper hydraulic fluid chamber 208 is defined in upper cylinder 32 between floating piston 98 and intermediate adapter 34. Thus, floating piston 98 is in communication with upper hydraulic fluid chamber 208 and air chamber 207, and floating piston 98 separates the upper hydraulic fluid chamber from the air chamber. It will be seen that in the initial position shown in FIG. 3B, the lower end of upper hydraulic fluid chamber 208 is closed by control valve 128.

Referring to FIGS. 3B and 3C, a lower hydraulic fluid chamber 210 is defined in lower cylinder 36 below intermediate adapter 34 and control valve 128 and above floating piston 180. Upper and lower hydraulic fluid chambers 208 and 210 are filled with low pressure hydraulic fluid when the apparatus is assembled.

A sampling chamber 214 is defined between floating piston 180 and check valve 164. In FIG. 3C, sampling chamber 214 is shown to initially consist primarily of annular volume 162. As will be further described herein, sampling chamber 214 enlarges to receive a fluid sample by movement of floating piston 180.

Sampling chamber 214 may also be referred to as a first chamber 214 in body 28, lower hydraulic fluid chamber 210 may be referred to as a second chamber 210, upper hydraulic fluid chamber 208 may be referred to as a third chamber 208, and air chamber 207 may be referred to as a fourth chamber 207.

In operation, sampler 10 is run into well 12 to collect samples from within wellbore 14. Sampler 10 may be conveyed in downhole tool 24 by placing it in a suitable carrier or other sampling apparatus 22, as previously described and shown in FIG. 2. This protects sampler 10 and allows it to be connected in communication with the work string bore, where presumably the sampled fluid will be. Tubing pressure may be communicated through a connector (not shown) engaged with sampling port 154 at threaded surface 156 in the lower end of lower adapter 38, and thus, tubing pressure is communicated to sampling or first chamber 214 of sampler 10 from a zone outside the sampler. This pressure is communicated through open check valve 164 and thus to floating piston 180. Those skilled in the art will see that this tubing pressure is thereby communicated to the hydraulic fluid in lower hydraulic fluid or second chamber 210. Because control valve 128 is initially closed, as seen in FIG. 3B, the hydraulic fluid in second chamber 210 is not allowed to flow into upper hydraulic fluid or third chamber 208, and therefore, wellbore fluid is prevented from entering sampler 10.

When a sample is to be taken, the activator is used to open control valve 128. As previously indicated, this activator may activate control valve 128 by various methods. In the illustrated embodiment, annulus pressure is applied in well 12 in a second zone outside sampler 10 sufficient to rupture disc 148.

Figure 4B:
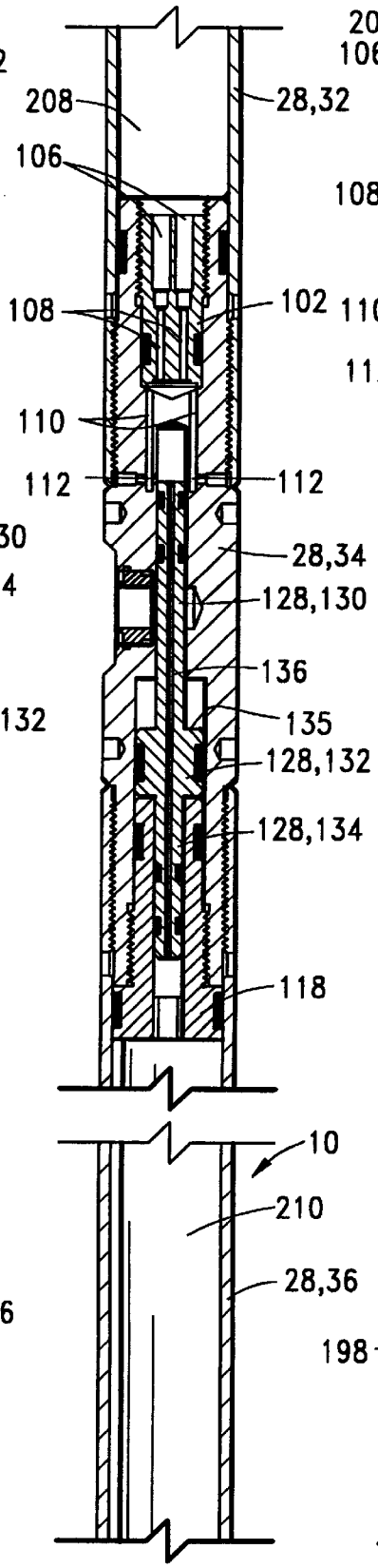
Figure 5B:
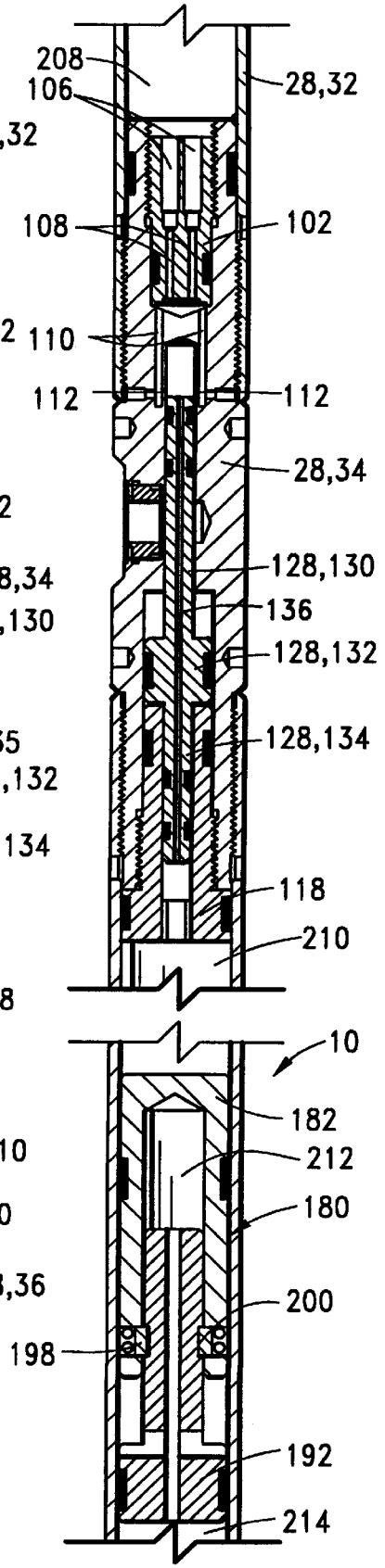
Figure 4C:
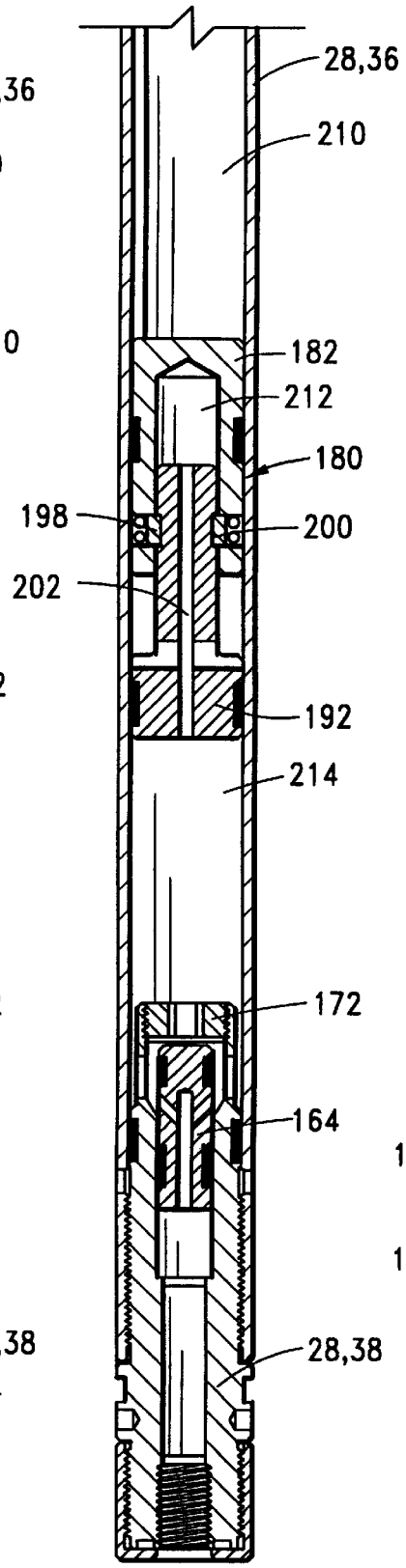

Referring now also to FIGS. 4A–4C, it will be seen that the well annulus fluid pressure is applied to shoulder 135 on central portion 132 of control valve 128, causing the control valve to be moved downwardly to the open position shown in FIG. 4B in which central portion 132 engages the top of valve adapter 118. When control valve 128 is opened, central opening 136 thereof is placed in communication with transverse portions 112 of passageways 110 and thus in communication with orifices 108. As previously stated, orifices 108 act as a flow restrictor for impeding fluid flow from second chamber 210 into third chamber 208. That is, this flow restrictor allows higher pressure hydraulic fluid in second chamber 210 to bleed slowly across the fluid restriction into third chamber 208.

As well fluid slowly enters sampler 10, the hydraulic fluid in second chamber 210 is displaced slowly into third chamber 208. Upper piston portion 182 of floating piston 180 moves upwardly within lower cylinder 36, while lower piston portion 192 initially remains substantially stationary. As upper piston portion 182 moves upwardly, thus extending floating piston 180, a variable volume 212 is formed and enlarged within floating piston 180. "Dirty" oil which initially flows into sampler 10 is drawn into volume 212 in floating piston assembly 180. In this way, contaminated oil, mud, etc., is separated from the clean oil sample to be taken subsequently.

Eventually, upper piston portion 182 of floating piston 180 moves sufficiently upwardly so that locking dogs 198 are aligned with groove 200 in lower piston portion 192. Because locking dogs 198 are radially inwardly biased, they will move inwardly to engage groove 200 so that upper piston portion 182 and lower piston portion 192 are locked together, and these components of floating piston 180 move together from then on. That is, after floating piston 180 is fully extended, the entire floating piston will start moving inside lower cylinder 36, as seen in FIG. 4C, thereby enlarging first chamber 214. As floating piston 180 moves upwardly, the hydraulic fluid in second chamber 210 above floating piston 180 will continue to flow into third chamber 208. This causes floating piston 98 in upper cylinder 32 to be moved upwardly until it engages the lower end of plunger 88, as seen in FIG. 4A.

Eventually, enough fluid will enter third chamber 208 so that floating piston 98 forces plunger 88 upwardly to engage lower portion 80 of isolation valve 74, thus causing upper isolation valve 74 to be moved upwardly, as seen in FIG. 4A, until the upper isolation valve reaches the open position shown in FIG. 5A. When isolation valve 74 is in this open position shown, outside hydrostatic pressure is allowed to flow into air or fourth chamber 207 through passageway 54. This hydrostatic fluid pressure acts against the area differential defined between enlarged upper end 90 and lower end 92 of plunger 88 and forces plunger 88, and thus floating piston 98, downwardly. This area is equal to the cross-sectional area of upper end 90 minus the cross-sectional area of lower end 92. The downward movement causes some reverse fluid flow and increased pressure in second and third chambers 210 and 208 and therefore in first chamber 214. This causes check valve 164 to be moved to the closed position shown in FIG. 5C.

It will be seen by those skilled in the art that the hydraulic fluid and the fluid sample are thus pressurized to a pressure above the well hydrostatic pressure. Ball check valve 68 in passageway 54 of upper adapter 30 will close and trap the hydrostatic pressure inside sampler 10 which continues to act downwardly on plunger 88. Sampler 10 may then be retrieved with the fluid sample contained therein in sample chamber 214 in its "supercharged" condition at a pressure above the well hydrostatic pressure.

The slow movement of fluid from second chamber 210 to third chamber 208 through orifices 108 allows the fluid sample to flow slowly into first chamber 214, thereby preventing fluid flashing. The supercharging of the fluid sample so that it is kept at a pressure above hydrostatic pressure greatly reduces or eliminates phase change degradation of the sample as sampler 10 is removed from well 12. In other words, regardless of the outside pressure conditions around sampler 10, once it is filled and locked as described, the fluid sample is above well hydrostatic pressure therein.

It will be seen, therefore, that the non-flashing downhole fluid sampler of the present invention is well adapted to carry out the ends and advantages mentioned, as well as those inherent therein. While a presently preferred embodiment of the apparatus and method of use has been shown for the purposes of this disclosure, numerous changes in the arrangement and construction of parts and steps may be made by those skilled in the art. All such changes are encompassed within the scope and spirit of the appended claims.

What is claimed is:

1. A fluid sampling apparatus comprising:

a body having a first chamber, a second chamber, a third chamber, and a sampling port defined therein, the sampling chamber being in communication with the first chamber and an outside zone outside the body; and a control valve, disposed in the body between the second and third chambers, for initially isolating the second chamber from the third chamber and for placing the second chamber in communication with the third chamber when activated so that fluid from the outside zone will flow through the sampling port into the first chamber in response to fluid flowing from the second chamber to the third chamber as a result of activation of the control valve.

2. The apparatus of claim 1 further comprising an activator for activating the control valve.

3. The apparatus of claim 2 wherein:

the body further defines a control port therein, the control port being communicated with the control valve and a second outside zone outside the body; and the activator is disposed in the control port and adapted for opening the control port and activating the control valve in response to pressure from the second outside zone.

4. The apparatus of claim 3 wherein the activator activates the control valve when a pressure differential between the second outside zone and the control valve reaches a predetermined level.

5. The apparatus of claim 4 wherein the activator comprises a rupture disc disposed across the control port.

6. The apparatus of claim 1 further comprising a floating piston disposed between the first and second chambers.

7. The apparatus of claim 6 wherein the floating piston comprises:

a first piston portion; and a second piston portion slidable with respect to the first piston portion such that a variable volume is defined therebetween.

8. The apparatus of claim 7 wherein the variable volume defined in the floating piston is in communication with the sampling port.

9. The apparatus of claim 1 further comprising a back check valve disposed in the sampling port for allowing fluid flow through the sampling port into the first chamber while preventing fluid flow from the first chamber outwardly through the sampling port.

10. The apparatus of claim 1 further comprising an isolation valve for allowing outside hydrostatic pressure into the body after a predetermined volume of fluid has flowed from the second chamber to the third chamber.

11. The apparatus of claim 10 further comprising a back check valve for trapping the hydrostatic pressure in the body.

12. The apparatus of claim 10 further comprising:

a floating piston in communication with the third chamber and movable in response to fluid flow from the second chamber to the third chamber.

13. The apparatus of claim 1 further comprising a flow restrictor, disposed in the body between the second and third chambers, for impeding fluid flow from the second chamber to the third chamber.

14. A fluid sampling apparatus comprising:

a body having a first chamber, a second chamber, a third chamber and a sampling port defined therein, the sampling port being in communication with the first chamber and an outside zone outside the body;

a control valve, disposed in the body between the second and third chambers, for initially isolating the second chamber from the third chamber and for placing the second chamber in communication with the third chamber when activated so that, as fluid flows from the second chamber to the third chamber, fluid from the outside zone will flow through the sampling port into the first chamber;

a floating piston disposed between the first and second chambers, the floating piston comprising:

a first piston portion; and a second piston portion slidable with respect to the first piston portion such that a variable volume is defined therebetween; and a lock for locking the first and second piston portions to one another after a predetermined movement of the second piston portion with respect to the first piston portion.

15. A fluid sampling apparatus comprising:

a body having a first chamber, a second chamber, a third chamber, and a sampling port defined therein, the sampling port being in communication with the first chamber and an outside zone outside the body;

a control valve, disposed in the body between the second and third chambers, for initially isolating the second chamber from the third chamber and for placing the second chamber in communication with the third chamber when activated so that, as fluid flows from the second chamber to the third chamber, fluid from the outside zone may flow through the sampling port into the first chamber;

an isolation valve for allowing outside hydrostatic pressure into the body after a predetermined volume of fluid has flowed from the second chamber to the third chamber;

a back check valve for trapping the hydrostatic pressure in the body;

a floating piston in communication with the third chamber and movable in response to fluid flow from the second chamber to the third chamber; and a plunger adjacent to the isolation valve and engagable by the floating piston such that the plunger is moved in response to the predetermined movement of the floating piston, thereby engaging and opening the isolation valve.

16. The apparatus of claim 15 wherein:

the body further defines an air chamber therein; and the plunger is disposed in the air chamber.

17. The apparatus of claim 15 wherein the plunger defines a differential area thereon such that, when the hydrostatic pressure is applied thereto, the plunger and floating piston are forced downwardly, thereby raising a pressure of fluid in the body to a level above the hydrostatic pressure.

* * * * *